US008097339B2

(12) United States Patent
Coughlin, Jr. et al.

(10) Patent No.: US 8,097,339 B2
(45) Date of Patent: Jan. 17, 2012

(54) SELECTIVE POLISHING OF FUSER MEMBERS

(75) Inventors: Daniel L. Coughlin, Jr., Elba, NY (US); Patrick J. Finn, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 819 days.

(21) Appl. No.: 12/144,884

(22) Filed: Jun. 24, 2008

(65) Prior Publication Data

US 2009/0317156 A1 Dec. 24, 2009

(51) Int. Cl.
*G03G 15/20* (2006.01)

(52) U.S. Cl. ..... 428/421; 399/279; 399/330; 399/333; 451/28

(58) Field of Classification Search ..... None
See application file for complete search history.

(56) References Cited

U.S. PATENT DOCUMENTS 5,945,223 A 8/1999 Kuntz et al.
6,636,709 B2 * 10/2003 Furukawa et al. ..... 399/69

* cited by examiner

*Primary Examiner* — Callie Shosho
*Assistant Examiner* — Patrick English
(74) *Attorney, Agent, or Firm* — MH2 Technology Law Group LLP

(57) ABSTRACT

A method of forming and a resulting selectively polished fuser member. The method includes selectively polishing that portion of the fuser member surface not subject to rapid natural wear. The method further includes polishing both a surface region subject to rapid sheet edge wear and a surface region not subject to rapid sheet edge wear, and polishing the surface region not subject to rapid sheet edge wear more than the surface region subject to rapid sheet edge wear. The rapid natural wear corresponds to sheet edge wear on the fuser member surface.

13 Claims, 4 Drawing Sheets

SELECTIVE POLISHING OF FUSER MEMBERS

DESCRIPTION OF THE INVENTION

1. Field of the Invention

The present invention relates to image forming apparatus and their fuser members and, more particularly, to methods of forming a fuser member to include a selectively polished fuser member surface.

2. Background of the Invention

In electrostatographic fixing systems, fuser members are often coated with a non-adhesive coating including fluoroelastomer polymer to overcome toner offsetting and staining, i.e. the adhesion of the heat softened toner particles onto the surface of the fuser member. In addition, these fluoroelastomer polymers can provide a release coating to a surface of the fuser members, such that a paper stripping is more easily accomplished. In other cases, the fluoroelastomer coating is of a type to provide both high gloss and good release of fused toner images. It is well known that the performance of the fuser members is dependent on the surface uniformity of the fuser member and substantial investment is made to provide a consistent and reliable fuser member.

After a fuser member has been installed in, for example an electrostatographic machine, the combination of fuser oil or fuser release agent, and/or toner, can form a sticky gel that adheres to the fuser member surface. In turn, this coating reduces the fuser member performance and longevity. Likewise, the repeated application and release of a sheet or the like on a surface of the fuser member can cause variations in surface uniformity of the fuser member, primarily due to toner and/or oil on the surface of the fuser member. Even further, the gloss of the fuser member can eventually vary over a surface of the fuser member as a result of repeated contact and stripping of paper from the fuser member. It is a discovery of the invention that the areas of greatest wear on the fuser surface correspond to edges of a sheet applied and released thereon. For example a sheet width of 11 inches centered on a fuser member will wear away the surface of the fuser member faster at edges of the paper. Similarly, if the sheet is edge aligned on the fuser member, then the edge wear (assuming the same size sheet) can form 11 inches from the alignment edge. This phenomenon can be referred to as sheet edge wear.

While a certain amount of wear can be expected with the repeated use of the same sized paper, the wear can eventually cause image defects on the print product. For example, fluoroelastomer (e.g. Viton™) coated fuser members, and especially those used in color fusing, have a failure mode whereby the prints have noticeable gloss variation as the fuser wears. While even the worn areas of the fuser member often yield absolute gloss that is well within normal specifications, a variation of as little as 2 gloss units between sheet edge wear regions and adjacent less worn regions can be cause for failure. This phenomenon can be referred to as Edge Delta Gloss (EDG) print defect.

Currently, in order to maintain uniformity of the fuser member, and more particularly, correct the EDG print defect, it is known to move the paper edge or accessories relative to the fuser member surface. Continuous adjustment of paper feed and/or hardware equipment eventually becomes ineffective.

It is further known that forming a fuser member often includes polishing of the surface. Polishing can help to make the surface uniform in appearance and can remove some potential surface defects. In addition, polishing the surface of a fluoroelastomer can improve release and/or stripping performance of the fuser member. Finally, polishing can provide a resulting surface higher in Fluorine, thereby improving offset and stripping performance. However, a problem has been found herein that polishing the fuser member surface causes a significant reduction in fuser life.

Typically, color machines have a significant quantity of failures associated with gloss variation in the prints at the paper edge, where the roll surface usually becomes dull compared to the high gloss of the rest of the roll. Particularly with color systems, the gloss variation may occur at a low number of prints while there is still plenty of life left in the coating release properties as well as the mechanical durability of the under layers which are typically silicone or fluorocarbon. According to the invention herein, the problem with polishing the fuser member surface is that it has been found to accelerate the EDG failure mode, as measured in stress testing when compared to the typical unsanded surface. An example of an iGen3 machine run to 2500 prints with 210 gsm stock provides support for this discovery. The attached graph of FIG. 1 illustrates the unsanded fuser member surface (C−) with a much better rating (3.5) than the typical fuser member surface sanded with a superfinisher using 9 um silicon carbine media (C+) at 5.5. This is a significant 2 SIR (Standard Image Reference, a rating scale developed for the purpose of evaluating Edge Delta Gloss) improvement in EDG.

Accordingly, polishing a surface of the fuser member provides advantages that would be lost if the surface were not polished. Previously, however, an entire surface of the fuser member has been polished, which directly leads to the EDG defects described.

Accordingly, there is a need to overcome these and other problems of prior art to provide a method for selectively polishing a fuser member surface.

SUMMARY OF THE INVENTION

In accordance with various embodiments, a fuser member is provided.

The fuser member can include a substrate having a first edge and a second edge; and a continuous fluoroelastomer layer disposed over an entire surface of the substrate, the continuous fluoroelastomer layer comprising a selectively polished region.

According to various embodiments, there is a method of making a fuser member.

The method can include selectively polishing those portions of the surface not subject to a great probability of high natural wear.

According to another embodiment, an image forming apparatus includes fuser member having a selectively polished surface.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

As used herein, the term "fuser member" is used interchangeably with the terms including fuser rolls, fuser belts, transfix members, pressure members and fuser films.

As used herein, "gloss" is measured in gloss units, which uses the angle of measurement and the gloss value at 75 degrees per the American Society for Testing and Materials (ASTM) D523 standard for the general evaluation of gloss.

Figure 1:
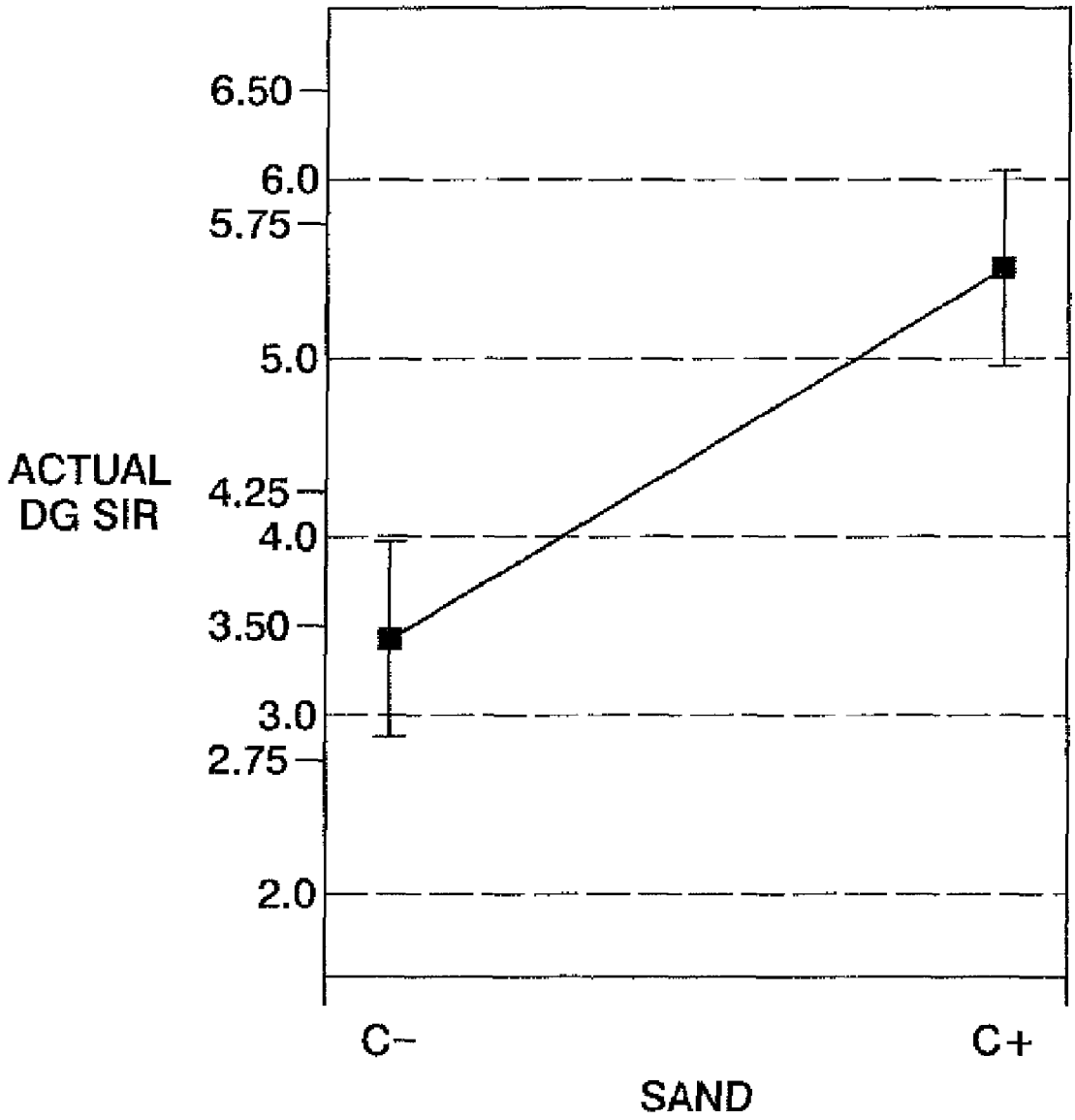
FIG. 1 is an effect graph depicting an effect of sanding on a fuser member surface.
Figure 2A:
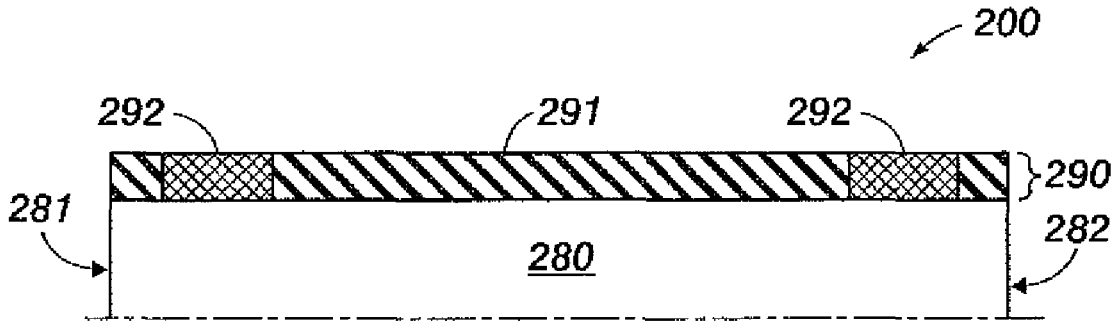
FIG. 2A schematically illustrates a cross sectional view of an exemplary fuser member, according to various embodiments of the present teachings.
Figure 2B:
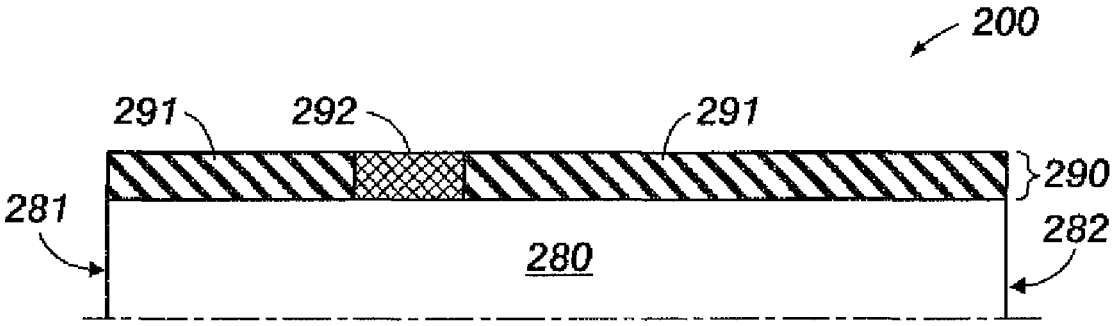
FIG. 2B schematically illustrates a cross sectional view of an exemplary fuser member, according to various embodiments of the present teachings.

FIGS. 2A and 2B schematically illustrate cross sectional views of exemplary fuser members 200, according to various embodiments of the present teachings. The fuser member 200 can include a substrate 280 having a first edge 281 and a second edge 282 and a continuous fluoroelastomer layer 290 disposed over a surface of the substrate 280. In various embodiments, the continuous fluoroelastomer layer 280 can include sheet edge wear regions 292 and non-sheet edge wear regions 291. In general, non-sheet edge wear regions can occur at areas other than those having sheet edge wear.

In some embodiments, the sheet edge wear region 292 can include two edges, as depicted in FIG. 2A, when a sheet is substantially centered on a surface of the fuser member 200 for processing. As depicted the FIG. 2A, the sheet edge wear 292 can have a width corresponding to some variance in a paper feed event, and appreciates that a groove or other wear pattern by the sheet to define the sheet edge may be greater than a finite line corresponding to the width of the paper used. It will also be appreciated that a region of sheet edge wear 292 is definable and constitutes a relatively more worn fuser surface than a remainder of the fuser surface. As shown in FIG. 2A, a distance between spaced sheet edge wear regions 292 can be about 11 inches, corresponding to a common size paper treated on the fuser member 200. In some embodiments, the sheet edge wear 292 can be a single edge, for example as depicted in FIG. 2B when one edge of a sheet is edge aligned on an edge of the fuser member 200 and an opposing edge of the sheet is within a surface span of the fuser member. Repeated use of various size paper or stock can result in similar sheet edge wear regions 292 formed according to edges of the size sheet, and a size of the sheet causing the sheet edge wear is not intended to limit the scope of the invention.

It will be appreciated that an alignment (registration) edge of a fuser member is typically not polished in the exemplary embodiments. However, the non-registration edge can vary in location according to factors such as sheet size, hardware and setup, and the non-registration edge therefore can be selectively polished or not according to wear parameters thereof.

In various embodiments, and as depicted in each of FIGS. 2A and 2B, in order to compensate for the eventual sheet edge wear regions 292 as depicted, the continuous fluoroelastomer layer 290 can be selectively polished in all regions which will exhibit low sheet edge wear. Further, the continuous fluoroelastomer layer 290 can be selectively polished to include a greater degree of polishing in regions exhibiting lower sheet edge wear and a relatively less degree of polishing in regions which exhibit more sheet edge wear. In each of FIGS. 2A and 2B, an exemplary selective polishing can be provided at region 291 of the continuous fluoroelastomer layer 290 with regions 292 remaining unpolished. Further, an exemplary selective polishing can provide a greater polish to the region 291 than to region 292. An amount of polishing can be determined according to a desired gloss and other desired characteristics of the fuser member surface. As described above, a difference in gloss between selectively polished regions and unpolished regions can be within a difference of no more than about 2 gloss units. Likewise, a difference in gloss between selectively more and less polished regions can be within a difference of about 2 gloss units on the print.

Any suitable material that has satisfactory heat transfer and strength characteristics can be used as the substrate 280 for the fuser member 200. The fuser member 200 can be a roll, belt, flat surface or other suitable shape used in the fixing or conditioning of thermoplastic or thermoset toner or ink images to a suitable media. The fuser member 200 can be a pressure member or a release agent donor member or a transfix member, preferably in the form of a cylindrical roll, belt, or film. Typically, the roll fuser member can be made of a hollow cylindrical metal core, such as copper, aluminum, steel, materials chosen to maintain rigidity, structural integrity, as well as being capable of having a fluoroelastomer coated thereon and adhered firmly thereto.

In various embodiments, the continuous fluoroelastomer layer 290 can include fluoroelastomer polymer selected from the group consisting of copolymers of vinylidene fluoride, hexafluoropropylene, and tetrafluorothylene; and terpolymers of vinylidene fluoride, hexafluoropropylene, and tetrafluorothylene. Other suitable polymers are described in detail in the U.S. Pat. No. 5,945,223, the disclosure of which is incorporated herein in its entirety.

In various embodiments, the continuous fluoroelastomer layer 290 can include a thickness from about 5 μm to about 250 μm when formed over the substrate 280. However, one of ordinary skill in the art would know that subsequent post coating operations, such as, for example, grinding and/or polishing can vary the initial thickness of the layer.

Figure 3:
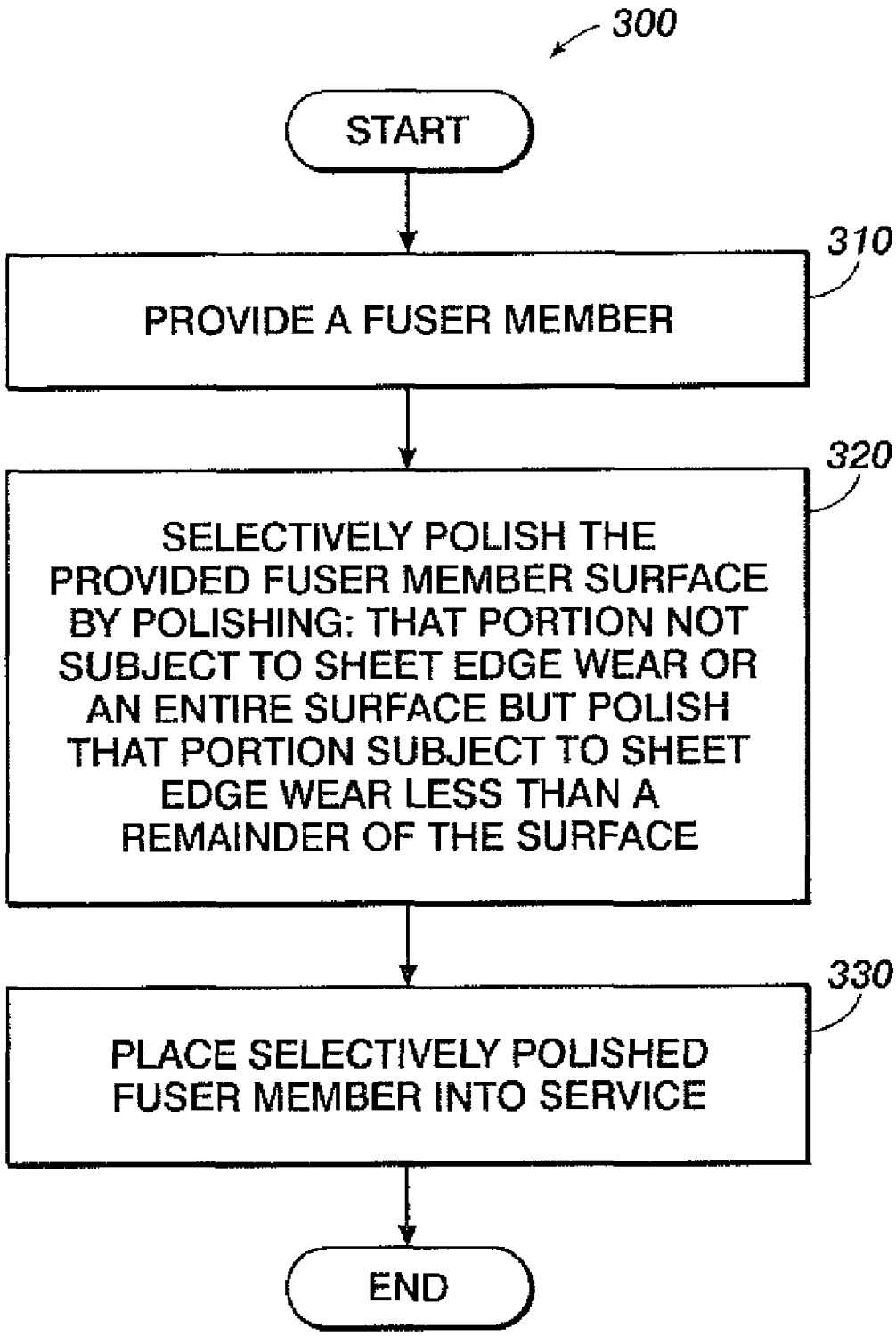
FIG. 3 shows a method of making a fuser member, according to various embodiments of the present teachings.

According to various embodiments, FIG. 3 shows a method 300 for forming the fuser of FIG. 200. In various embodiments, the method 300 can include selectively polishing a fuser member surface in a region other than the rapid sheet edge wear region 292. In various embodiments, the method 300 can include selectively polishing a fuser member surface which will have no and/or low sheet edge wear relative to that of a rapid sheet edge wear region. More specifically, a fuser member is provided at 310. A surface of the provided fuser member is selectively polished at 320. The selective polishing can polish that portion of the fuser member surface not subject to rapid sheet edge wear. The selective polishing can polish an entire surface of the fuser member, but polish that portion subject to rapid sheet edge wear less than a remainder of the surface. At 330, the selectively polished fuser member is put into service, for example in the image forming apparatus of FIG. 4.

Figure 4:
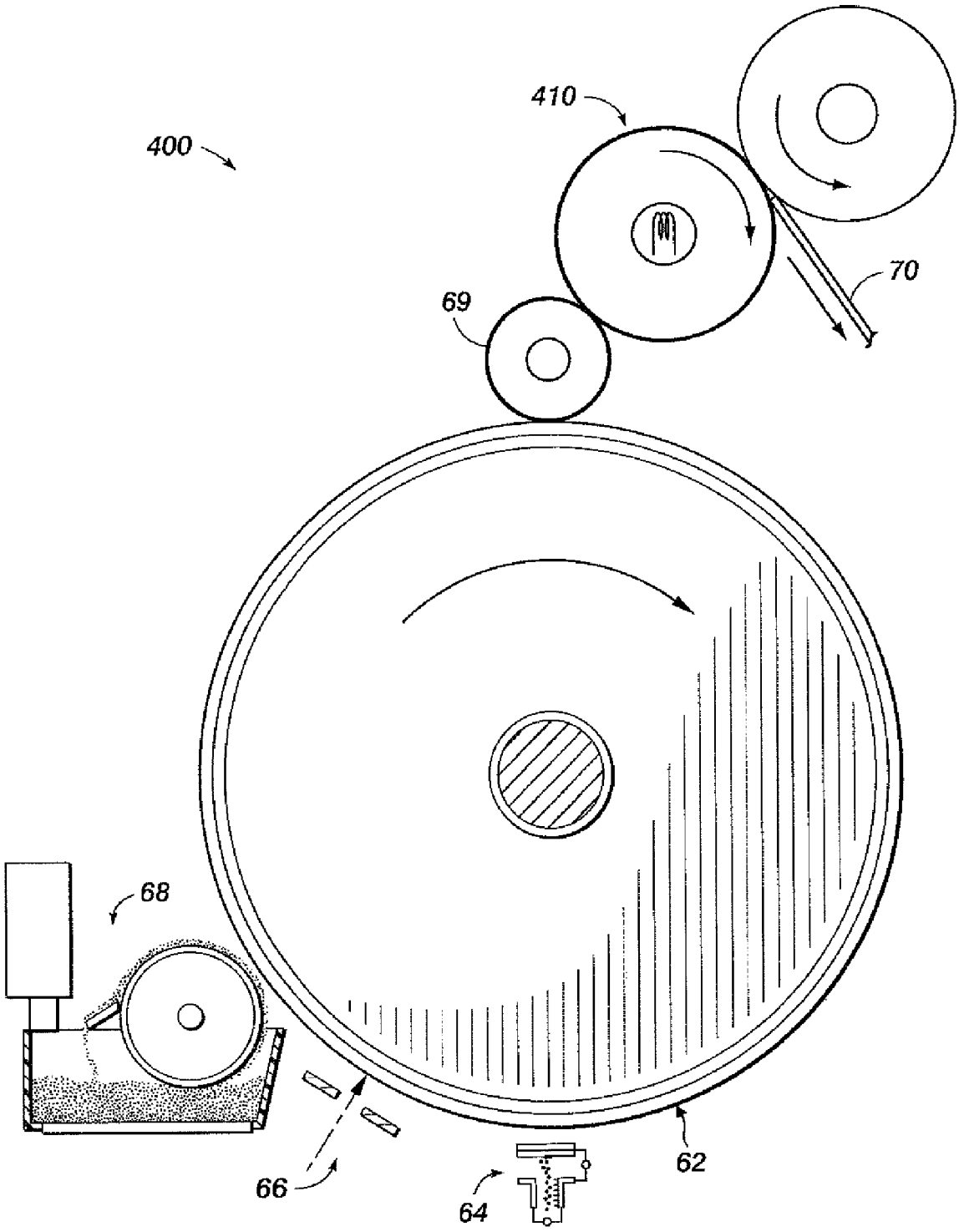
FIG. 4 shows an exemplary image forming apparatus, according to various embodiments of the present teachings.

According to various embodiments, an image forming apparatus 400 is shown in FIG. 4. The image forming apparatus 400 can include a receptor 62 to receive an electrostatic latent image, at least one charging component 64 for uniformly charging the receptor 62, and at least one imaging component 66 to form a latent image on the receptor 62. The image forming apparatus 400 can also include at least one development component 68 for converting the latent image to a visible image on the receptor 62 and a transfer component 69 for transferring the visible image onto a media. The image forming apparatus 600 can further include a fuser member 410 as shown and described in detail in connection with FIGS. 2A and 2B for fusing the visible image onto media 70. The fuser member 410 can be selectively polished in all regions which will likely not exhibit rapid sheet edge wear. Further, the fuser member 410 can be selectively polished to include a greater degree of polishing in regions not exhibiting rapid sheet edge wear and a relatively less degree of polishing in regions which do exhibit rapid sheet edge wear. An amount of polishing can be determined according to a desired gloss and other desired characteristics of the fuser member surface. As described above, a difference in gloss between selectively polished regions and unpolished regions can be within a difference of no more than about 2 gloss units. Likewise, a difference in gloss between selectively more and less polished regions can be within a difference of about 2 gloss units.

The exemplary fuser member 410 shown in the apparatus 400 is a fuser roll. However, the process described above can be used to provide fuser belts or films. The fuser belts or films can be preferably mounted on a cylindrical mandrill and processed in a manner process similar to that heretofore described, with the outer surface of the belt or film being selectively polished.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A fuser member comprising:

a substrate having a first edge and a second edge;

a continuous fluoroelastomer layer disposed over a surface of the substrate such that the fluoroelastomer layer contacts a print medium during printing of an image onto the print medium, the fluoroelastomer layer comprising:

a first fluoroelastomer layer region at a first substrate location which is subject to a first sheet edge wear, wherein the first fluoroelastomer layer region is polished to a first degree; and a second fluoroelastomer layer region, which is subject to rapid natural wear by contact with the print medium, at a second substrate location which is subject to a second sheet edge wear which is higher than the first sheet edge wear, wherein the second fluoroelastomer layer region comprises a second degree of polishing which is less than the first degree.

2. The fuser member of claim 1, wherein the second fluoroelastomer layer region comprises only that portion of the surface of the substrate which is subject to rapid natural wear by contact with the print medium.

3. The fuser member of claim 2, further comprising:

the second fluoroelastomer layer region is disposed over the surface of the substrate so as to contact the print medium during printing of the image onto the print medium;

the second fluoroelastomer layer region is unpolished; and the second fluoroelastomer layer region comprises a surface region subject to rapid sheet edge wear during contact with the print medium during printing of the image onto the print medium.

4. The fuser member of claim 1, further comprising:

the first fluoroelastomer layer region is disposed over the surface of the substrate to contact the print medium during printing of the image onto the print medium; and the first fluoroelastomer layer region comprises a surface region not subject to rapid sheet edge wear during contact with the print medium during printing of the image onto the print medium.

5. The fuser member of claim 4, further comprising two second fluoroelastomer layer regions, wherein the first fluoroelastomer layer region is interposed between the two second fluoroelastomer layer regions.

6. The fuser member of claim 5, wherein the second fluoroelastomer layer region substantially corresponds to one edge of a fused sheet print medium.

7. The fuser member of claim 4, wherein the second fluoroelastomer layer region is inset from longitudinal edges of the fuser member.

8. The fuser member of claim 7, wherein the second fluoroelastomer layer region substantially corresponds to outer edges of a fused sheet print medium.

9. The fuser member of claim 1, wherein a difference between the first fluoroelastomer layer region and the second fluoroelastomer layer region comprises an edge delta gloss (EDG) of less than about two gloss units.

10. The fuser member of claim 1, wherein the second fluoroelastomer layer region is unpolished.

11. An image forming apparatus comprising:

a receptor to receive an electrostatic latent image;

at least one charging component for uniformly charging the receptor;

at least one imaging component to form a latent image on the receptor;

at least one development component for converting the latent image to a visible image on the receptor;

a transfer component for transferring the visible image onto a media; and a fuser member for fusing the visible image onto the media, wherein the fuser member comprises:

a substrate having a first edge and a second edge; and a continuous fluoroelastomer layer disposed over a surface of the substrate such that the fluoroelastomer layer region contacts a print medium during printing of an image onto the print medium, the continuous fluoroelastomer layer comprising a selectively polished surface, wherein the fluoroelastomer layer comprising:

a first fluoroelastomer layer region at a first substrate location which is subject to a first sheet edge wear, wherein the first fluoroelastomer layer region is polished to a first degree; and a second fluoroelastomer layer region, which is subject to rapid natural wear by contact with the print medium, at a second substrate location which is subject to a second sheet edge wear which is higher than the first sheet edge wear, wherein the second fluoroelastomer layer region comprises a second degree of polishing which is less than the first degree.

12. The image forming apparatus of claim 11, further comprising:

the first fluoroelastomer layer region is disposed over the surface of the substrate to contact the print medium during printing of an image onto the print medium; and the first fluoroelastomer layer region comprises a surface region not subject to rapid sheet edge wear during contact with the print medium during printing of the image onto the print medium.

13. The image forming apparatus of claim 11, wherein the second fluoroelastomer layer region is unpolished.

* * * * *